United States Patent [19]

Chang

[11] Patent Number: 4,909,124

[45] Date of Patent: Mar. 20, 1990

[54] XYLOPHONE WITH METAL PIPES

[76] Inventor: Yen-Cheu Chang, No. 6, 1 Lane Darfon Rd., Shangon, Taichung, Taiwan

[21] Appl. No.: 196,361

[22] Filed: May 19, 1988

[51] Int. Cl.[4] ..... G10D 13/08

[52] U.S. Cl. ..... 84/403

[58] Field of Search ..... 84/402, 403, 404, 405

[56] References Cited

U.S. PATENT DOCUMENTS

| | | | |
|---|---|---|---|
| 967,477 | 8/1910 | Winterhoff | 84/403 |
| 1,576,263 | 3/1926 | Bartholomae | 84/403 |
| 2,117,345 | 5/1938 | Miessner | 84/403 |
| 2,153,725 | 4/1939 | Sanders | 84/402 |
| 2,458,193 | 1/1949 | Packheiser | 84/403 |

*Primary Examiner*—L. T. Hix
*Assistant Examiner*—Brian W. Brown
*Attorney, Agent, or Firm*—Erik M. Arnhem

[57] ABSTRACT

The discovered xylophone has a plurality of metal pipes which are respectively supported by way of foam-rubber pads on a support frame the lateral members of which has support channels, in which are positioned the foam-rubber pads. A fastening wire extends through small holes in one protective strip atop the metal pipes and one lateral frame members respectively so as to retain the pipes in place.

4 Claims, 2 Drawing Sheets

XYLOPHONE WITH METAL PIPES

BACKGROUND OF THE INVENTION

In conventional and current xylophones, the tone-producing members may be classified into three types: the flat strip type, the curved strip type, and the hollow pipe type.

The sound or tone producing members of the flat strip type are mounted on a triangular or circular frame with fixing parts made of rigid material. However, the sound quality of this type of xylophone is poor when the tone-producing members are contacted, because the supporting frame and the fixing parts are in contact with the tone-producing members, thereby hindering or off-setting generation of melodious notes or tones.

In contrast, xylophones having hollow pipes have excellent tonal qualities. However, these also have disadvantages. Since the pipes are not fixed in place, the respective foam-rubber pads are susceptible to damage. As well, because the tone-producing pipes tend to be small pipes that have a larger curved part, the actual area which can be struck is also quite narrow and small. Therefore, it is rather difficult to strike the exact part of the pipe so as to create a particular tone. Finally, since the tone-producing pipes are not fixed, the pipes could easily be lost or damaged when the xylophone is moved or handled excessively, thus providing an added inconvenience to the user.

SUMMARY OF THE INVENTION

In the lateral frame members of the present invention, there are channels in which are inserted square wave-shaped foam-rubber pads which preclude that the three sides of the metal tone-producing pipes contact the frame.

Thus, when the tone-producing pipes are struck, the tone which is produced can be longer-lasting and of a pleasing quality.

The metal tone-producing pipes of the present invention are fixed to the frame with a fastening wire which prevents the pipes from dislodging and without jeopardizing the resulting vibrations and, hence, the tonal quality of the tone-producing pipes.

According to the present invention, the sectional view of a metal tone-producing pipe shows that it has a square bottom and a curved top surface. Thus, a player can easily strike the curved top surface to produce the desired tone.

DETAILED DESCRIPTION

Figure 1:
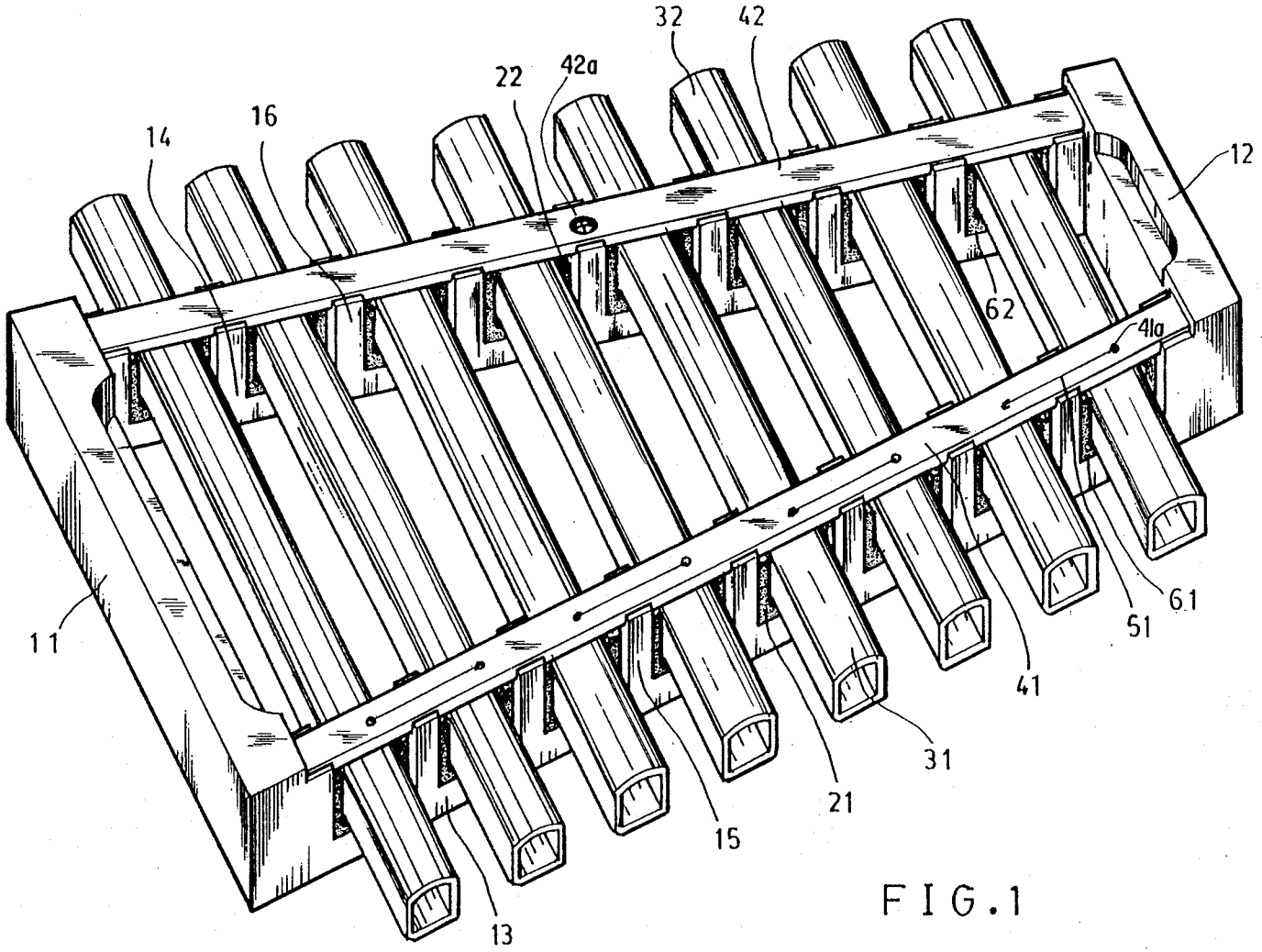
FIG. 1 is a perspective view of a xylophone according to the present invention.

FIG. 1 illustrates a perspective view of the components of the present invention, including four frame members 11, 12, 13, and 14, which can be molded as an integral piece. Mounted at the frame are foam-rubber pads 21 and 22, and a plurality of rigid metal pipes, two being identified in the drawing FIG. 1 by reference numerals 31 and 32 and which are graduated with respect to length.

When considered in cross section, each metal pipe has a curved top and a flat bottom with perpendicular walls. The flat bottom facilitates the mounting of the tone-producing pipes.

The pipes are covered by protective strips 41 and 42, respectively, and a fastening wire 51 holds each pipe in place so that each pipe can properly produce a respective note.

Figure 2:
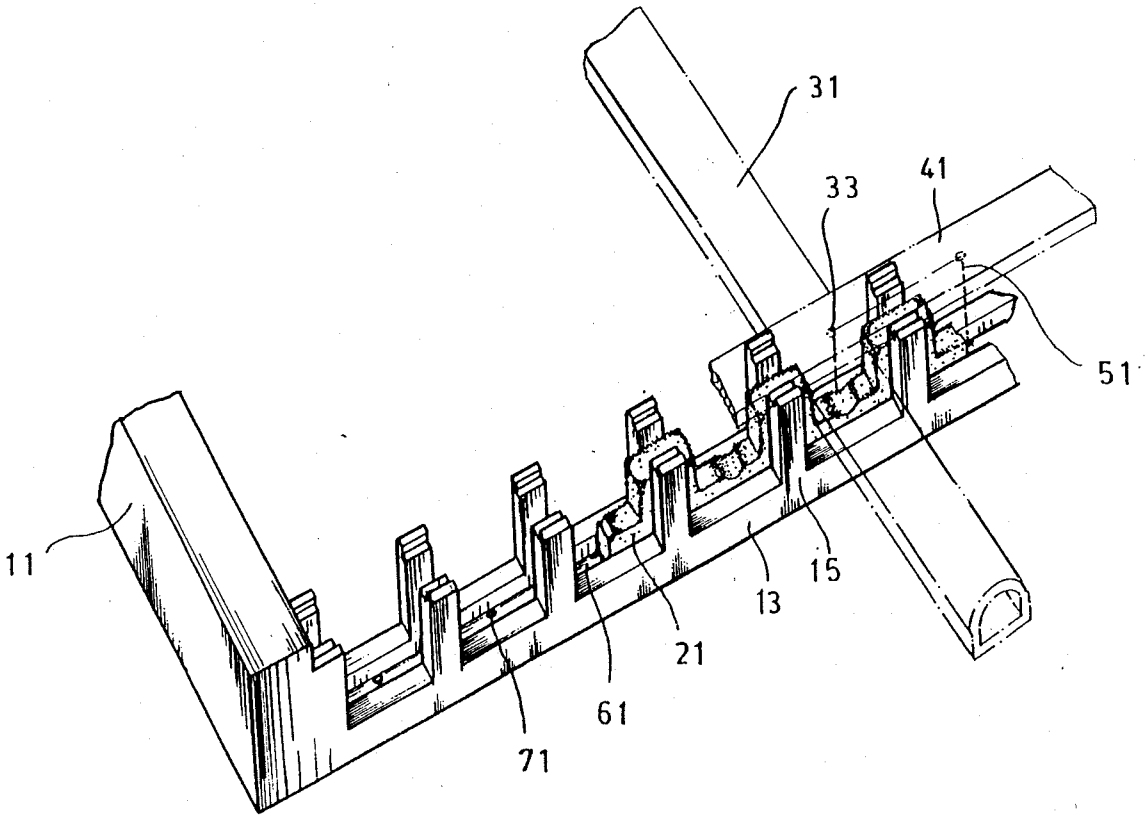
FIG. 2 is a fragmentary perspective view of part of the frame.

FIG. 2 illustrates a fragmentary perspective view of part of the frame of the xylophone according to the present invention.

This view clearly shows the relation between the various parts, and vertical exterior pegs 15 as well as interior pegs 16 in between which are respectively positioned the foam-rubber pads 21 and 22.

The tone-producing pipes 31 and 32 extend transversely with respect to the frame member 13, the protective strips 41 and 42, and the fastening wire 51.

The frame of the present invention includes two frames end-portions 11 and 12, and two lateral frame members 13 and 14, which help to give the xylophone the appearance of a long ladder.

The two lateral frame members 13 and 14 are furnished with the mentioned vertical pegs 15 and 16 which respectively provide channels 61 and 62 in which can be inserted the tone-producing pipes (31 and 32).

In each of the channels 61 and 62 of the two lateral frame members 13 and 14 is positioned a flexible foam-rubber pad 21 and 22, so as to prevent the three sides of a tone-producing pipe from contacting the rigid part of the xylophone frame. Thus, each of the pipes can produce a clear tone with a regulated duration upon being impacted or struck.

Each tone-producing pipe has a small hole 33, which corresponds to a small hole 71 between the vertical pegs 15 and 16 in the lateral frame members 13 and to a small hole **41*a* in the protective strip 41. When a tone-producing pipe is placed in the channels 61 and 62 on the two lateral frame members 13 and 14 between two vertical pegs 15 and 16, the small holes 41*a* in the protective strip 41, the small holes 33 in the tone-producing pipe 31 and the small holes 71 in the lateral frame member 13 are aligned with one another so as to facilitate the passing through of a fastening wire 51 which fixes the mentioned components together. The protective strip 42 on the rear lateral frame member 14 is fixedly mounted on the vertical pegs 16 with a screw 42*a* to prevent the tone-producing pipes from moving out from between the vertical pegs 16**.

On the protective strip 42, numerical notations are marked with seven different colours to indicate the seven scale notes. This serves two purposes: it facilitates use by a beginner who is learning to play, and it provides a decorative appearance.

I claim:

1. A xylophone comprising:

a frame structure including two frame end-portions, and said frame structure including two supporting lateral frame members, said frame end-portions and said supporting lateral frame members forming a long ladder-shaped structure;

each of said two supporting lateral frame members being provided with a plurality of vertical pegs and having a channel along the center line on the top thereof for mounting a respective one of a plurality of wave-shaped pads; at least one supporting lateral frame member being furnished with a plurality of small holes between vertical pegs so as to insert a respective fastening wire through corresponding holes in at least one metal tone-producing pipe;

a plurality of metal tone-producing pipes, each pipe having a curved top surface, a planar bottom and vertical walls; and each of said tone-producing pipes having a small hole in registry with a respective one of said small holes in said at least one supporting lateral frame member;

a plurality of wave-shaped pads, one each located between a respective pair of pegs in each channel; and for each supporting lateral frame member a protective strip, with at least one protective strip being also furnished with small holes corresponding to those holes in said tone-producing pipes; and after a respective tone-producing pipe has been put on said two supporting lateral frame members between respective vertical pegs, said small holes in said protective strips, said tone-producing pipes, and said supporting lateral frame member being aligned with respect to one another so as to let a respective fastening wire penetrate and secure said tone-producing pipes.

2. The xylophone according to claim 1, wherein said pads are foam rubber pads.

3. The xylophone according to claim 1, wherein on at least one protective strip numerical notations are marked with seven different colours to indicate the seven scale notes.

4. The xylophone according to claim 1, wherein the respectively other protective strip is fixed in place with a screw to prevent said tone-producing pipes from dropping out at that other lateral frame member.

* * * * *